United States Patent [19]

Jaunin

[11] 4,253,173

[45] Feb. 24, 1981

[54] DUAL DISPLAY SYNCHRONIZATION SYSTEM FOR A TIMEPIECE

[75] Inventor: Jean-Pierre Jaunin, La Neuveville, Switzerland

[73] Assignee: Societe Suisse pour l'Industrie Horlogere Management Services S.A., Bienne, Switzerland

[21] Appl. No.: 84,500

[22] Filed: Oct. 15, 1979

Related U.S. Application Data

[63] Continuation-in-part of Ser. No. 891,367, Mar. 29, 1978, abandoned.

[51] Int. Cl.[3] ..... G04B 19/24; G04G 5/00

[52] U.S. Cl. ..... 368/76; 368/34; 368/185; 368/186

[58] Field of Search ..... 58/4 A, 23 A, 23 D, 58/23 R, 50 R, 85.5, 58; 368/34, 76, 185, 188

[56] References Cited

U.S. PATENT DOCUMENTS

| | | | |
|---|---|---|---|
| 3,815,351 | 6/1974 | Vovelle | 58/58 |
| 3,901,022 | 8/1975 | Cleusix et al. | 58/85.5 |
| 3,911,665 | 10/1975 | Van Berkum | 58/50 R |
| 4,030,283 | 6/1977 | Sautnier et al. | 58/23 R |
| 4,085,577 | 4/1978 | Natori | 58/23 D |

*Primary Examiner*—Edith S. Jackmon

*Attorney, Agent, or Firm*—Griffin, Branigan & Butler

[57] ABSTRACT

A timepiece is described having an electromechanical analogue display for certain information and an electronic digital display for other information. Synchronizing means for the displays may consist of a signal generator associated with the analogue display driving mechanism and arranged so that at predetermined periodic intervals the signal generator may be operated so as to provide a synchronizing signal to the digital display.

8 Claims, 3 Drawing Figures

DUAL DISPLAY SYNCHRONIZATION SYSTEM FOR A TIMEPIECE

RELATED APPLICATIONS

This application is a continuation-in-part of copending application Ser. No. 891,367 filed Mar. 29, 1978, now abandoned.

BACKGROUND OF THE INVENTION

It has already been proposed to provide timepieces having the usual time indicating hands with digital means for indicating information such as dates or time interval settings. Purely mechanical arrangements in this respect have been known for many years at least in respect of date indicating arrangements and no particular difficulty is experienced when it comes to synchronizing date changes with the hour displayed. Thus normally in such time pieces the arrangement is such that the date changes at midnight.

With the advent of electronic timepieces, particularly wrist watches, the problem arises of providing synchronization between an electro-mechanical arrangement on the one hand and a purely electronic arrangement on the other. Although such dual display timepieces have been produced, the problem of synchronization has to the present time not been satisfactorily resolved.

It is realized for instance that the electronic portion of such timepieces generally includes various registers which provide volatile storage of data. Thus at any time when the energizing current is cut off, as for instance when the battery in a wrist watch is replaced, the data within such registers disappears immediately and before the instrument becomes fully useful it must be completely re-synchronized. It is likewise desirable to enable maintaining of synchronization taking into account that this may be lost to a slighter degree merely through the inherent difference between electro-mechanical and purely electronic arrangements.

Known solutions to this problem have provided, among others, a system in which the watch hands are set at 12:00 (=24:00), then by pressing on one or several switches the digital display may be synchronized. The known arrangement, although needing only to be used after power failure (in the case of a wrist watch following battery change) constitutes a complex set of operations which might well be beyond the capacity of the average person.

A further possibility might provide a switch actuated by a cam which could represent the position of the hands at midnight. The difficulty with such arrangement resides in its obvious lack of precision and probable lack of reliability.

The solution proposed by the present invention provides a synchronization system which will go into operation automatically following cutting and restoring of the current as in the case of a wrist watch when the battery is changed. Other applications of the system will be discussed hereinafter in the description to follow.

SUMMARY OF THE INVENTION

A timepiece provided with an electro-mechanical analogue means arranged to display certain time information and an electronic digital means arranged to display other time information wherein is included a signal source and a signal detector in association with a predetermined element within the analogue display driving gear train, the signal source capable of being periodically energized and the predetermined element being provided with signal transmitting means having a predetermined positional relationship in respect of the electro-mechanical analogue means whereby at at least one setting of said electro-mechanical analogue means a signal is transmitted and detected to assure synchronization of both the analogue and the digital means.

DETAILED DESCRIPTION

Figure 3:
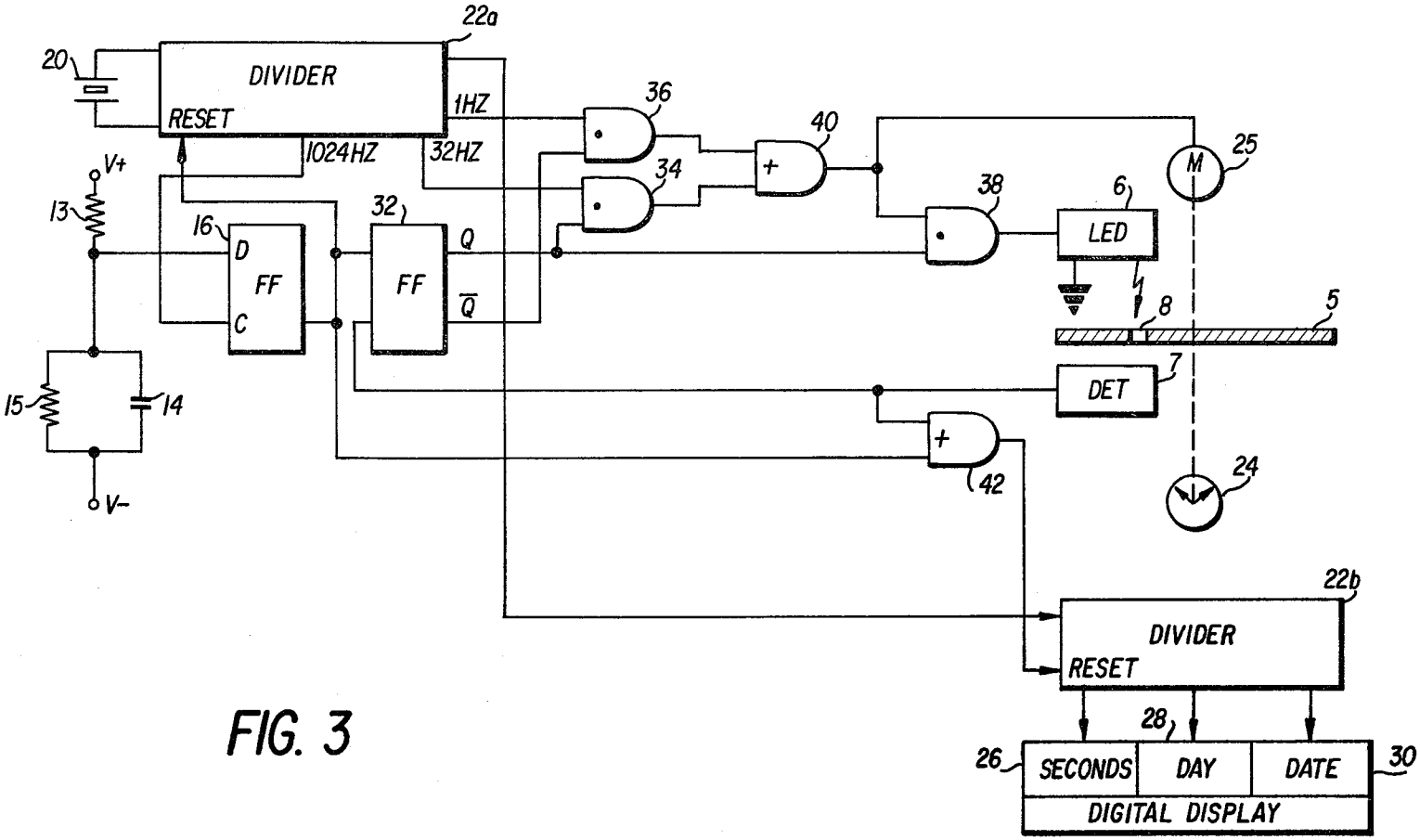
FIG. 3 shows a circuit detail of the arrangement used when a new battery is placed within the watch movement.

By now the basic concepts underlining the design and construction of electronic timepieces using quartz frequency standards are too well known to require extensive description thereof. Basically, such timepieces may, as illustrated in FIG. 3, include a frequency standard such as a quartz crystal 20, a frequency divider means *22a,22b* used in reducing the frequency of the standard output down to a frequency suitable for display purposes and finally displaying means for the information which in some cases may take the form of an analogue display 24 driven for instance by a miniaturized stepping motor 25 or the like and in other cases may take the form of a digital or electronic display 26,28,30.

As shown for instance in U.S. Pat. application Ser. No. 673,328 (assigned to the same assignee as the present application) it is possible to make effective use of both types of display in the same timepiece. In that particular patent application the concern was rather to provide a circuit which would enable both timekeeping and time measuring functions to be performed wherein the timekeeping function was displayed by the traditional analogue means and the time measuring function by an electronic digital display.

As a non-limiting example of an application of the present invention it is proposed that the previous disclosure be modified in such a manner as to permit the digital display portion thereof to display calendar information in addition to time measuring information. In such case the present invention serves as a means of synchronizing the calendar display with that of the time indicating hands whereby the calendar may be expected to change over at midnight every day.

As a further example of a timepiece in which this invention might be employed reference may be made to U.S. Pat. No. 3,911,665.

Figure 1:
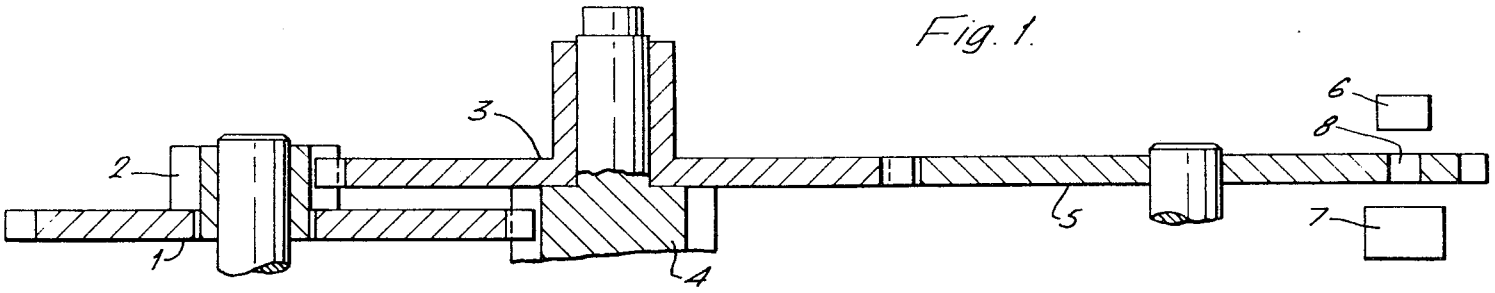
FIG. 1 shows a cross-sectional view of the analogue portion of the timepiece of this invention.

In FIG. 1 there is shown a cross-section, greatly simplified, of a timepiece movement such as might be used to form the analogue portion of a timepiece in accordance with the invention. It is, of course, to be realized that such timepiece movement will ordinarily be driven by means of a stepping motor as illustrated in FIG. 3. Thus, in FIG. 1, 1 and 2 designate respectively a minute wheel and pinion which are directed to driving an hour wheel 3 and a cannon pinion 4. Hour wheel 3 furthermore drives a synchronizing disc 5. At one point in the surface of disc 5 in the example as shown there is an aperture 8. Placed at one location within the movement is a signal emitting means or optical sensing means such as a light emitting diode 6 placed on one side of synchronizing disc 5 and a photoelectric detector cell, such as a phototransistor 7, placed on the other side of disc 5. It is thus clear that when normally the disc material intervenes between light emitting diode 6 and photocell detector 7 no signal is transmitted. When, however, by virtue of the continuing movement of disc 5 the aperture 8 passes between the LED 6 and the photocell detector 7 a signal is passed between the two whereby photocell detector 7 may itself emit a signal. It will be clear that when construction of the timepiece movement is undertaken the aperture 8 and the photocell detector 7 along with LED 6 will be so placed as to coincide with a predetermined setting of the timepiece hands such as for instance at midnight.

Figure 2:
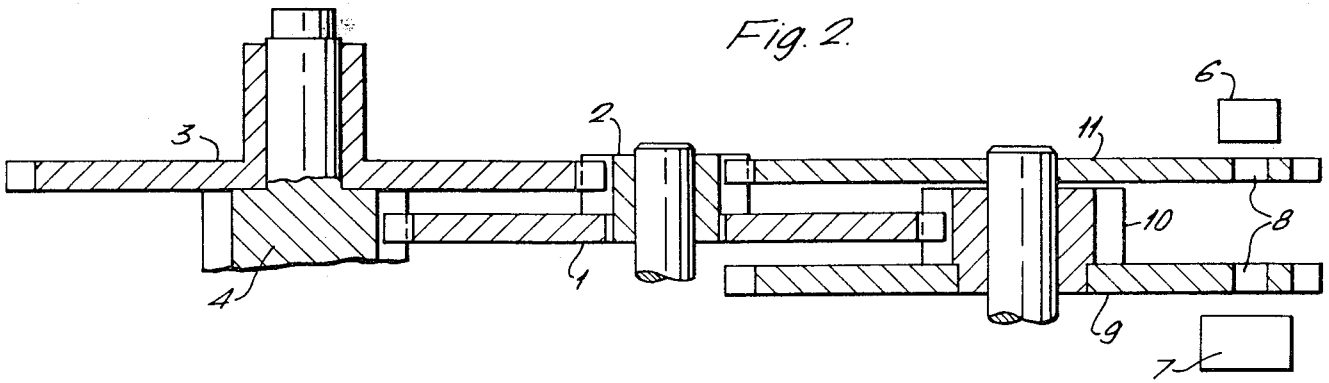
FIG. 2 constitutes a variant of FIG. 1.

FIG. 2 shows essentially the same mechanism except that in this case synchronizing disc 5, which moves in accordance with the hour wheel 3, is replaced by a pair of synchronizing discs 9 and 11 which are synchronized respectively with the cannon pinion and the hour wheel, although as actually shown they may be driven by the minute wheel and pinion.

Both of discs 9 and 11 are provided with apertures 8 and it may thus be appreciated that a greater precision is obtainable in aligning the discs with the precise midnight setting at which it is desired to effect a calendar change-over or synchronizing operation.

FIG. 3 shows a circuit detail from an arrangement suitable for driving a timepiece constructed in accordance with this invention. Thus, in FIG. 3, 12 constitutes the usual integrated circuit which in addition to the standard components includes an RC circuit comprised of resistance 13 and capacitor 14. A further resistance 15 may be provided which acts as a bleeder. Finally, there is provided a pulse forming circuit 16 which as shown may take the form of an ordinary D-type flip-flop.

Further provided are circuits which may respond to the output of D-flip-flop 16 in order to bring about the objectives of this invention and such circuits may, among others, resemble for instance circuits as shown in U.S. Pat. Nos. 3,901,022 or 4,030,283 for example. These circuits include, for example, a flip-flop 32, AND gates 34, 36 and 38, and OR gate 40. AND gate 36 is responsive to frequency divider 22*a* for providing normal advancing pulses at, for example, a frequency of 1 Hz. or 1/60 Hz., for normally advancing motor 25.

The operation of the invention is as follows. When the battery is removed or in any other way the power is cut off from a timepiece such as that of the invention it will be evident that all electrically stored information is immediately lost. Thus, the contents of all registers of the timepiece will be lost. Upon placing a new cell within the timepiece or otherwise restoring the power, RC circuit 13 and 14 reacts to derice a pulse which is available to set D-flip-flop 16 by virtue of the 1024Hz. clock pulse obtainable from the frequency divider 22*a* for instance. The output pulse $\overline{Q}$ obtainable from the flip-flop 16 is applied to reset all registers and all stages within the frequency divider 22*a*,22*b*, the reset pulse being applied to frequency divider 22*b* through OR gate 42. The output pulse $\overline{Q}$ may moreover be employed to set flip-flop 32 which in turn enables AND gate 34 to pass fast advancing pulses such as has been described in U.S. Pat. No. 4,030,283. The fast advancing pulses pass through AND gate 34 and OR gate 40 to drive motor 25. The fast advancing pulses are obtained by bypassing certain stages of the frequency divider whereby motor driving pulses are obtained from a higher stage and are thus at a higher frequency. As a result the display advancing motor steps at a much more rapid rate say for example 32 times per second instead of once per second or as is known in some cases once per minute.

The result thus is that the display 24 is stepped rapidly and in a preferred arrangement with each motor stepping pulse the LED 6 will be flashed. Rapid advance of the time indicating hands thus corresponds with the rapid advance of the synchronizing disc. At such time as the aperture of the synchronizing disc passes between the LED 6 and the photocell detector 7 a signal will be developed at the detector. Such signal, it will be readily appreciated, is led back into the integrated circuit and at this point is employed to stop the rapid advance. This may be effected by means of a gating arrangement or through resetting of the flip-flop 32. The output of detector 7 acts through OR gate 42 to reset the divider 22*b* during the digital display, thus bringing the digital and analogue displays into synchronism.

It will thus be evident that upon insertion of a new power cell or restoration of the energizing means the timepiece will undergo a rapid advance of the mechanical time indicating hands until such time as these pass through a chosen time setting such as midnight for example whereupon a pulse will be developed to the synchronizing means as shown in either of FIGS. 1 and 2 and this signal will serve to stop the rapid advance and to set the digital display which may for instance consist of a calendar display.

Thereafter the timepiece user may proceed with normal time setting in being assured that the calendar display will remain in synchronization with the other information displayed.

It will be evident that such a system may be in fact further employed in lieu of other arrangements simply to effect changeover of the date each day at midnight. In this respect it would be necessary to arrange for operation of the LED only under certain specified conditions and at certain specified moments. In the case of the resetting and synchronizing of the digital display with the analogue mechanical display it is also evident that it is normally only during this synchronizing operation that the LED will be energized.

Where such a system is used in the case of an alarm type watch having a digital display of the alarm setting it is important furthermore to know exactly the position of the hands. This may be known through counting of the number of motor pulses supplied following synchronization at 24:00 or 12:00.

As a possible variation it is also possible to replace the RC circuit as used in the reset operation by a simple mechanical arrangement which would place the timepiece in its synchronization mode following replacement of the battery.

A further variation within the scope of this invention may employ reflecting means in association with a synchronizing disc in place of the aperture. In such case the signal source i.e. an LED element, and the detector, i.e. a phototransistor, are so located that at a predetermined rotational position of the synchronizing disc the luminous signal from the LED is transmitted by reflection to the detector.

I claim:

1. A timepiece comprising:

a time standard driving a frequency dividing means;

an electro-mechanical analogue means responsive to said frequency dividing means and including analogue display means and a driving gear train arranged to drive said analogue display means for displaying certain time information;

an electronic digital display means advanced by said frequency dividing means for displaying other time information;

said driving gear train including a predetermined means having a signal transmitting means, said signal transmitting means having a predetermined positional relationship with respect to said analogue display means;

a signal detector means;

a signal source positioned to direct a signal to said signal detector means via said signal transmitting means;

advancing means for advancing said electro-mechanical analogue means at a rate faster than said electronic digital means is advanced by said frequency dividing means;

means for initiating said advancing means; and means responsive to said detector means for halting said advancing means and resetting said frequency dividing means whereby said digital display means and said analogue display means are synchronized.

2. A timepiece as in claim 1 wherein said predetermined means includes at least one disc arranged to be rotated in synchronism with said electro-mechanical analogue means, and said signal transmitting means comprises aperture means traversing the plane of said disc whereby said aperture means exhibits a predetermined rotational location at periodic intervals.

3. A timepiece as in claim 1 wherein said predetermined means includes first and second discs arranged to be rotated respectively in synchronism with hour and minute hand driving means, said signal transmitting means comprising an aperture arranged in each disc so that the aperture will be simultaneously aligned with a predetermined rotational location at periodic intervals.

4. A timepiece as in claim 3 wherein said discs are coaxial.

5. A timepiece as in claim 2 wherein said signal source comprises a light emitting diode arranged radially proximate said aperture means and a first side of said disc, said signal detector means comprising a photocell having the same radial and angular location as said light emitting diode and positioned proximate the opposite side of said disc, and circuit means responsive to said advancing means for periodically exciting said light emitting diode.

6. A timepiece as in claim 3 wherein said signal source comprises a light emitting diode arranged radially proximate said aperture means and a first side of said first disc, said signal detector means comprising a photocell having the same radial and angular location as said light emitting diode and positioned proximate the remote side of said second disc, and circuit means responsive to said advancing means for periodically exciting said light emitting diode.

7. A timepiece as claimed in claim 1 wherein said means for initiating said advancing means includes means for sensing the insertion of a battery in said timepiece.

8. A timepiece as claimed in claim 1 and including means responsive to said advancing means for periodically energizing said signal source.

* * * * *